US006984315B2

(12) United States Patent
Dolton, III

(10) Patent No.: US 6,984,315 B2
(45) Date of Patent: Jan. 10, 2006

(54) POOL CLEANING DEVICE

(76) Inventor: Edward Gerard Dolton, III, 189 Manorside Dr., Brick, NJ (US) 08724

( * ) Notice: Subject to any disclaimer, the term of this patent is extended or adjusted under 35 U.S.C. 154(b) by 1 day.

(21) Appl. No.: 10/736,937

(22) Filed: Dec. 16, 2003

(65) Prior Publication Data

US 2005/0126969 A1 Jun. 16, 2005

(51) Int. Cl.
*E04H 4/16* (2006.01)

(52) U.S. Cl. ..... 210/169; 210/238; 210/416.2; 210/489; 15/1.7; 4/490

(58) Field of Classification Search ..... 210/169, 210/232, 238, 416.1, 416.2, 484, 488, 489; 15/1.7; 4/490
See application file for complete search history.

(56) References Cited

U.S. PATENT DOCUMENTS

| | | | | |
|---|---|---|---|---|
| 3,439,368 | A * | 4/1969 | Myers | 15/1.7 |
| 3,886,616 | A | 6/1975 | Hayes | |
| 4,338,697 | A | 7/1982 | Broadwater | |
| 4,402,101 | A * | 9/1983 | van Zyl | 15/1.7 |
| 4,692,956 | A | 9/1987 | Kassis | |
| 4,786,334 | A | 11/1988 | Nystrom | |
| 4,835,810 | A * | 6/1989 | Hugo | 15/1.7 |
| 5,044,034 | A | 9/1991 | Iannucci | |
| 5,093,950 | A | 3/1992 | Heier | |
| 5,293,659 | A | 3/1994 | Rief et al. | |
| 5,336,403 | A * | 8/1994 | Marbach | 210/169 |
| 5,351,355 | A | 10/1994 | Chiniara | |
| 5,435,031 | A | 7/1995 | Minami et al. | |
| 5,507,058 | A * | 4/1996 | Minami et al. | 15/1.7 |
| 5,569,371 | A | 10/1996 | Perling | |
| 5,842,243 | A | 12/1998 | Horvath et al. | |
| 5,915,431 | A | 6/1999 | Doussan | |
| 5,933,899 | A | 8/1999 | Campbell et al. | |
| 5,961,822 | A | 10/1999 | Polimeni, Jr. | |
| 6,039,886 | A | 3/2000 | Henkin et al. | |
| 6,155,657 | A | 12/2000 | Elrich et al. | |
| 6,199,237 | B1 | 3/2001 | Budden | |
| D460,625 | S | 7/2002 | Wright | |
| 6,473,927 | B1 | 11/2002 | Sommer | |
| 6,601,255 | B1 | 8/2003 | Van Der Meyden et al. | |
| 6,725,489 | B1 * | 4/2004 | Zell | 15/1.7 |
| 2001/0050093 | A1 | 12/2001 | Porat | |
| 2003/0132152 | A1 | 7/2003 | Illingworth | |

FOREIGN PATENT DOCUMENTS

| | | | |
|---|---|---|---|
| EP | 0 323883 | A1 | 7/1989 |
| EP | 0 565 226 | A1 | 10/1993 |

* cited by examiner

*Primary Examiner*—Fred G. Prince
(74) *Attorney, Agent, or Firm*—Kaliko & Yeager, LLC; Scott H. Kaliko

(57) ABSTRACT

A swimming pool cleaning apparatus that includes a housing with a substantially hollow cavity that runs along the longitudinal axis of the housing; a handle means mounted to the housing for providing directional control and movement of the housing; a wheel means movably mounted to the housing for facilitating forward, backward, and angular movement of the housing along a swimming pool surface; a debris agitator means rotatably attached to the housing to facilitate water movement through the housing and the removal of debris from the swimming pool surface; a scraping means attached to the bottom of the housing for scraping the swimming pool surface; and a debris collection means detachably connected to the housing that filters debris from pool water and that allows filtered pool water to exit from the debris collection means.

11 Claims, 7 Drawing Sheets

195
230
330
220
240
197
198
120
110
160
145
150

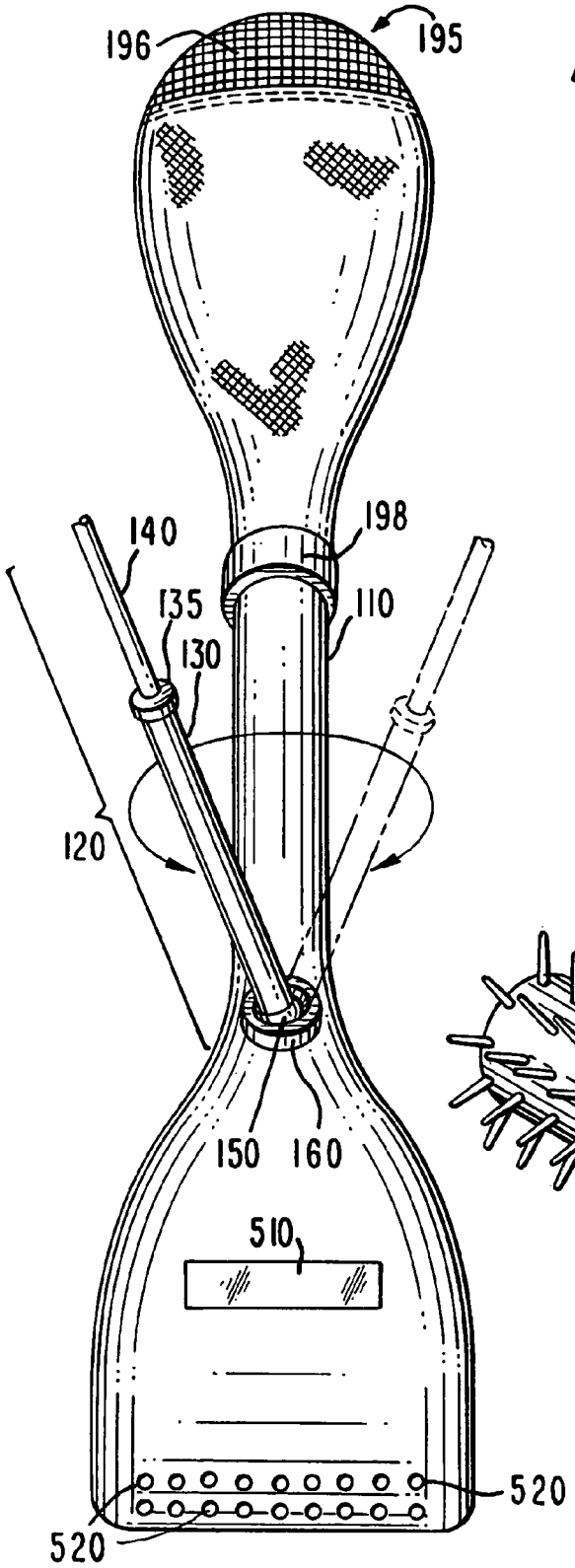
FIG. 5
FIG. 8a
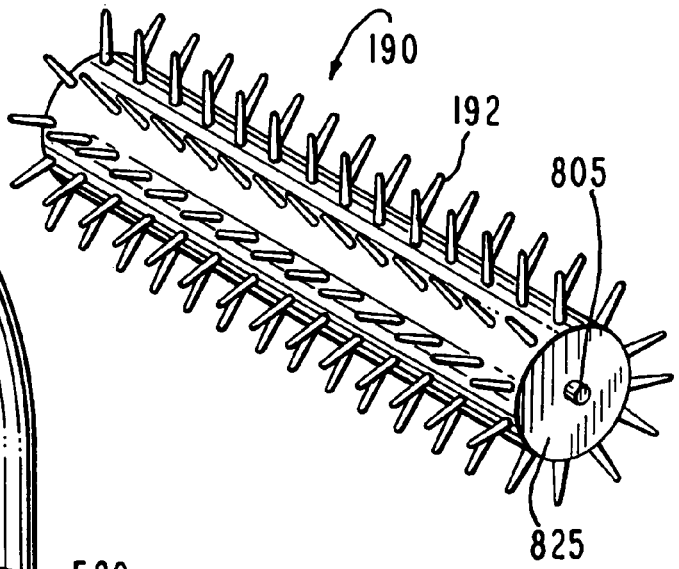

FIG.6
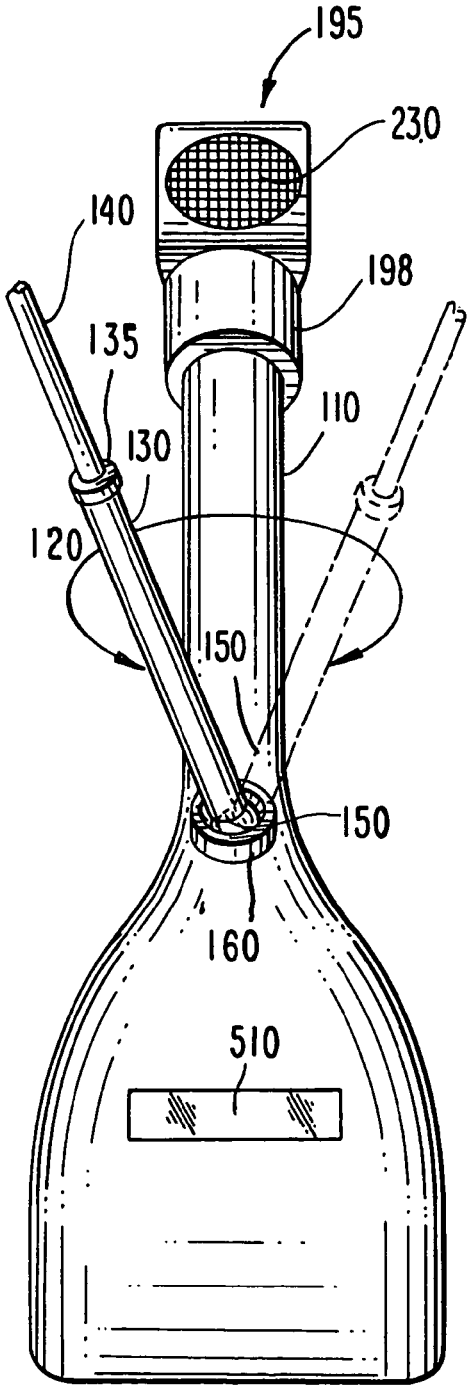
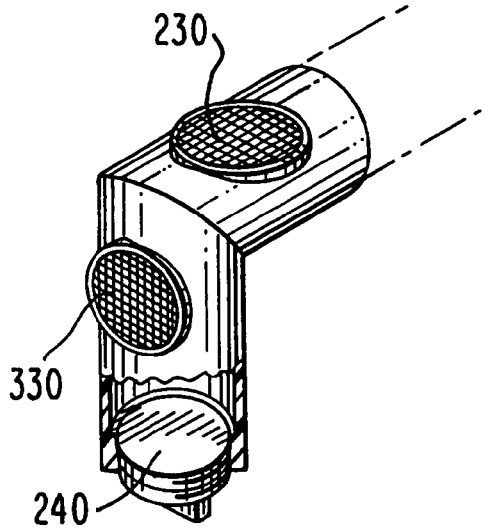
FIG.7

POOL CLEANING DEVICE

BACKGROUND OF THE INVENTION

This invention relates to a swimming pool cleaning device. More particularly, this invention relates to a device for cleaning a swimming pool without the use of additional hoses or suction devices.

Conventional swimming pool cleaning devices often have disadvantages associated with their use. One such disadvantage is that often these devices require a user to attach separate hoses and use additional devices in order to begin cleaning. Additional devices may include one or more hoses that typically must be attached a pool's filtration/cleaning system or a separate standalone system in order to provide the necessary suction to remove debris from the bottom of a pool. These additional hoses are often cumbersome and often take up a significant amount of storage space.

Another drawback with using conventional pool cleaning devices is that if such devices are improperly attached to the to a pool's filtration/cleaning system, damage to this system may occur.

It therefore would be desirable to provide a pool cleaning device that does not use cumbersome additional devices and that eliminates the potential damage to the swimming pool's filtration/cleaning system.

SUMMARY OF THE INVENTION

An object of the present invention is to provide a swimming pool cleaning device without the use of additional hoses or suction devices.

Another object of the present invention is to provide a swimming pool cleaning device that eliminates the potential danger to a swimming pool's filtration/cleaning system.

In accordance with this invention an apparatus for cleaning a swimming pool without the use of additional hoses or suction devices is provided. The apparatus may include a housing with a substantially hollow cavity that runs along the longitudinal axis of the housing; a handle means mounted to the housing for providing directional control and movement of the housing; a wheel means movably mounted to the housing for facilitating forward, backward, and angular movement of the housing along the swimming pool surface; a debris agitator means rotatably attached to the housing to facilitate water movement through the housing and the removal of debris from the swimming pool surface; a scraping means attached to the bottom of the housing for scraping the swimming pool surface; and a debris collection means detachably connected to the housing that filters debris from pool water and that allows filtered pool water to exit from the debris collection means.

The above and other objects, features, and advantages of the present invention will become apparent upon consideration of the of the following detailed description, taken in conjunction with the accompanying drawings, in which like reference characters refer to like parts throughout.

BRIEF DESCRIPTION OF THE DRAWINGS

FIG. 5 shows a top view of an embodiment of a pool cleaner that may be used for performing the present invention.

FIG. 6 shows a top view of an embodiment of a pool cleaner that may be used for performing the present invention.

FIG. 7 shows a top rear view of an illustrative example of one embodiment of debris collection device.

FIG. 8*a* shows an illustrative embodiment of a debris agitator means according to the invention.

DETAILED DESCRIPTION OF THE PREFERRED EMBODIMENTS

Figure 1:
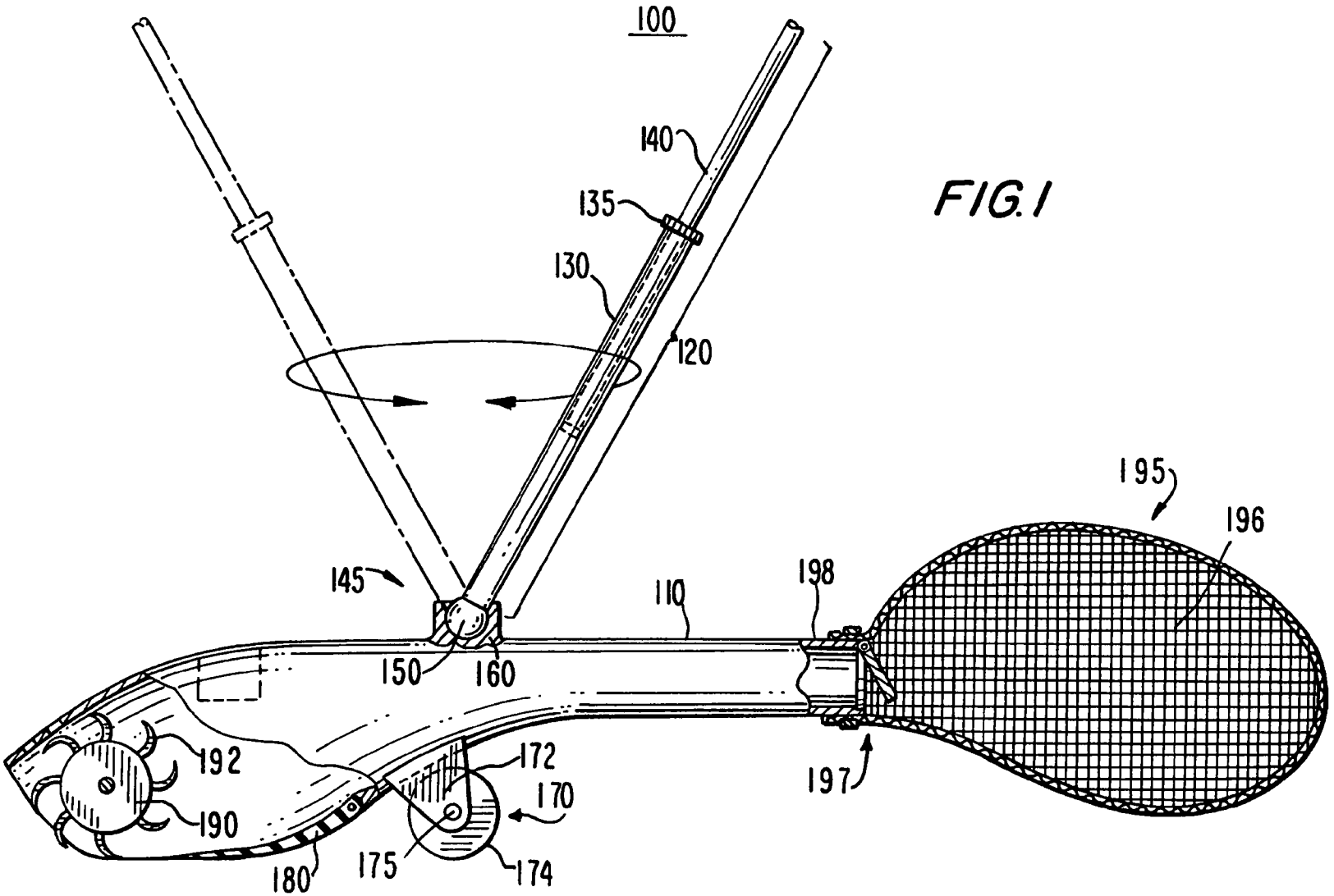
FIG. 1 shows a side view of an embodiment of a pool cleaner that may be used for performing the present invention.

An apparatus according to the invention includes a housing defined by a top section, a rear section, two side sections, a bottom section, and a substantially hollow cavity that runs along the inner longitudinal axis of the housing. The apparatus may also include a handle means mounted to the housing for providing directional control and movement of the housing; a wheel means movably mounted to the housing for facilitating forward, backward, and angular movement of the housing along the swimming pool surface; at least one debris agitator means rotatably attached to the housing to facilitate water movement through the housing and the removal of debris from the swimming pool surface; a scraping means attached to the bottom of the housing for scraping debris from the swimming pool surface; and a debris collection means detachably connected to the housing that filters debris from pool water and that allows filtered pool water to exit from the debris collection means.

In one embodiment of the present invention the debris agitator means rotatably attached to the housing may be mechanically geared to the rotational movement of the wheel means.

In another embodiment of the present invention the rotation of the wheel means and/or the rotation of the debris agitator means may be electrically controlled.

FIGS. 1–4 show a side view of four preferred embodiments of an apparatus 100 according to the invention. Apparatus 100 may include housing 110, handle means 120, handle attachment means 145, wheel means 170, scraping means 180, debris agitator means 190, debris collections means 195, flow valve 197, and debris collection locking means 198.

In FIGS. 1–4, housing 110 may be attached to handle means 120 using handle attachment means 145. For example, handle attachment means may include universal ball 150 and universal socket 160 or any other suitable attachment device or devices that allows handle means 120 to be manipulated in a 360-degree motion.

Figure 2:
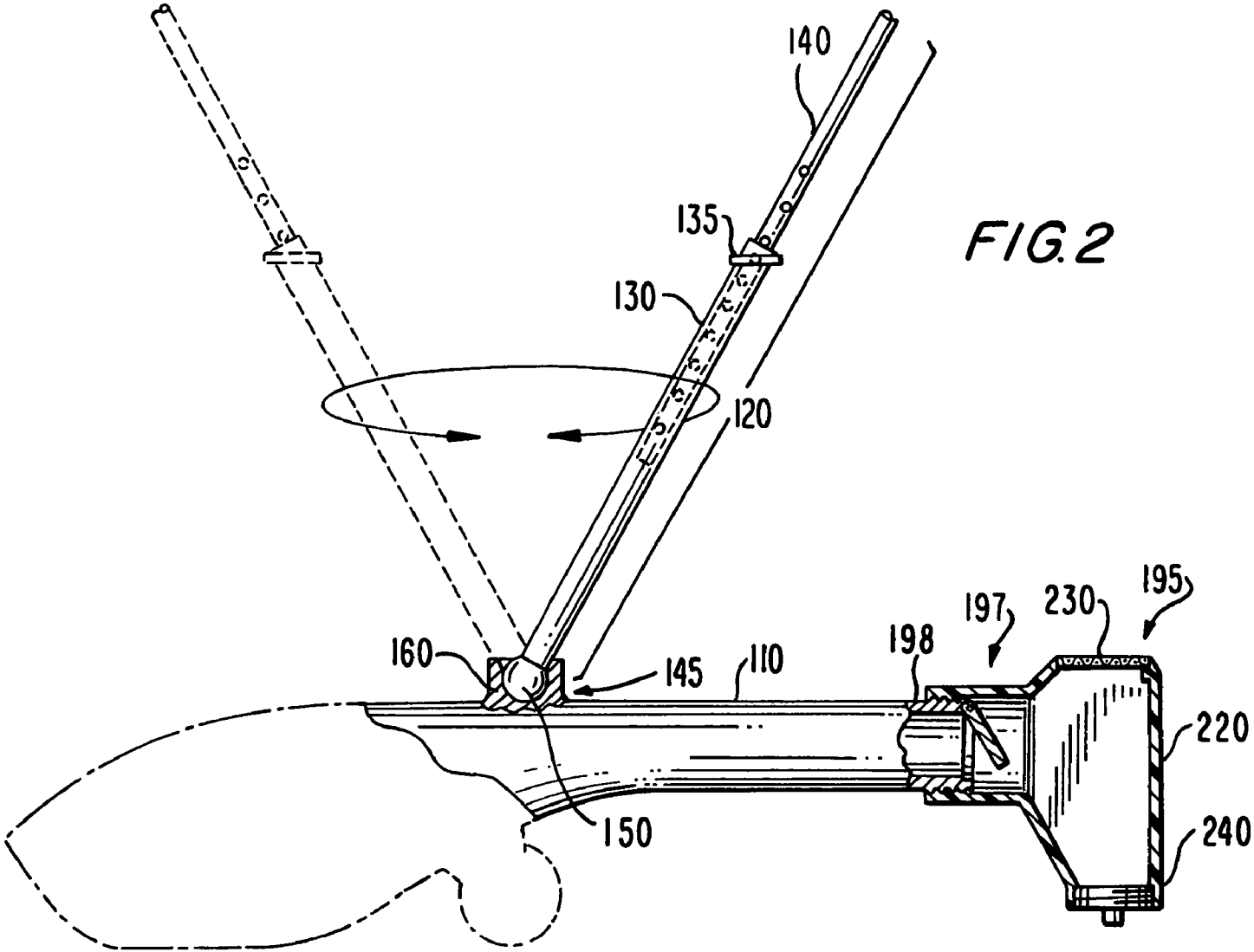
FIG. 2 shows a partial side view of an embodiment of a pool cleaner that may be used for performing the present invention.
Figure 3:
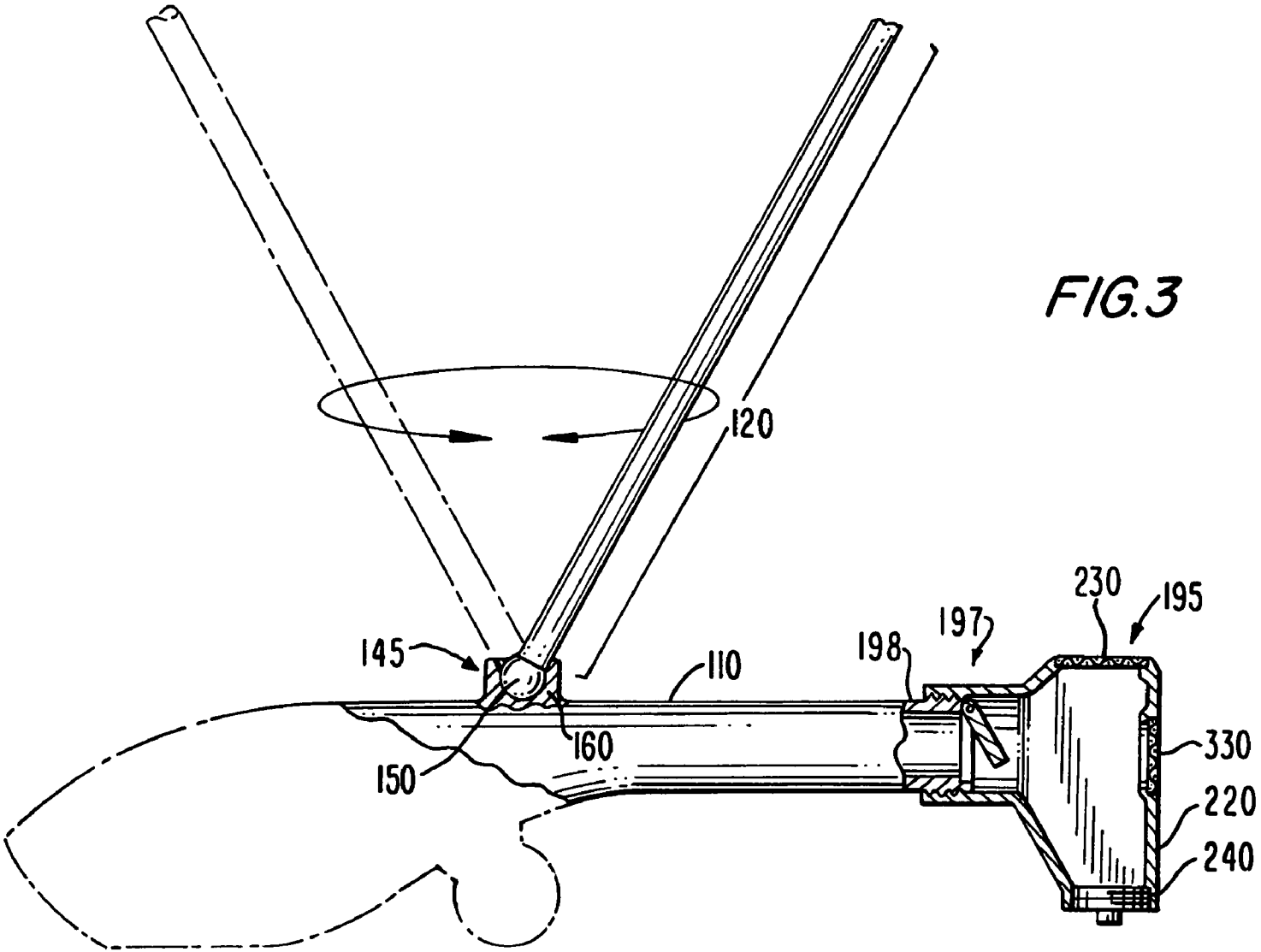
FIG. 3 shows a partial side view of an embodiment of a pool cleaner that may be used for performing the present invention.
Figure 4:
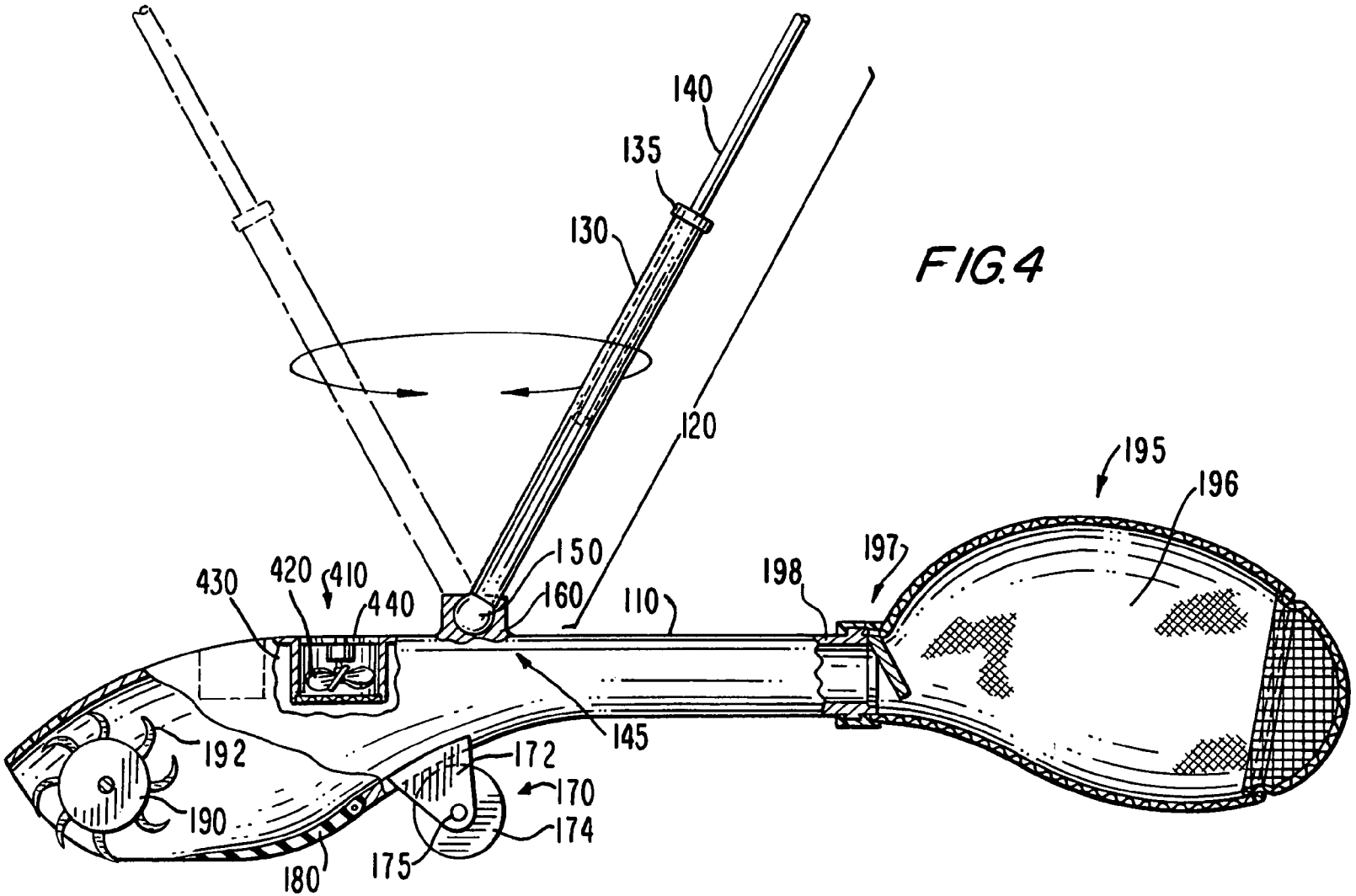
FIG. 4 shows a side view of an embodiment of a pool cleaner that may be used for performing the present invention.

The length of handle means 120 may be fixed (as shown in FIG. 3) or may be adjustable (as shown in FIGS. 1, 2, and 4). When handle means 120 is adjustable, handle means 120 may include handle cylinder 130, handle locking means 135, and handle extension 140. The length of handle means 120 may be adjusted by either collapsing or extending handle extension 140 into or from handle cylinder 130 and by applying handle extension locking means 135. For example, handle cylinder 130 may have a larger diameter than handle extension 140 to allow handle extension 140 to adjustably slide in and out of handle cylinder 130. When handle extension 140 is at a desired length, handle extension locking means 135 may be applied. Handle extension locking means 135 may, for example, be a twist lock device (as shown in FIGS. 1 and 4), a pin (as shown in FIG. 2), a spring-loaded pin (not shown), or any other suitable means for rigidly attaching handle cylinder 130 and handle extension 140 at a fixed desired length.

As mentioned above, apparatus 100, as shown in FIGS. 1–4, may also include wheel means 170. Wheel means 170 may include wheel housing 172, wheel 174, and wheel cylinder 175. Wheel housing 172 may be bottom mounted, side mounted, or mounted in any other suitable arrangement to housing 110. For example, wheel 174 may be rotatably coupled to wheel housing 172 using wheel cylinder 175 or a like device. Wheel means 170 may include a single wheel (as shown in FIGS. 1–4) or a plurality of wheels (not shown).

Apparatus 100 may also include scraping means 180 for scraping the bottom of a swimming pool. Scraping means 180 may be rigidly fixed or flexibly mounted to housing 110. Scraping means 180 may be comprised of rigid, semi-rigid, or flexible material (e.g., steel, hard plastic, flexible plastic, or any other suitable material). As shown in FIGS. 1–4, scraping means 180 is preferably angularly constructed to facilitate scraping debris from the pool bottom. Alternatively, scraping means 180 may be linearly constructed (not shown).

Figure 8B:
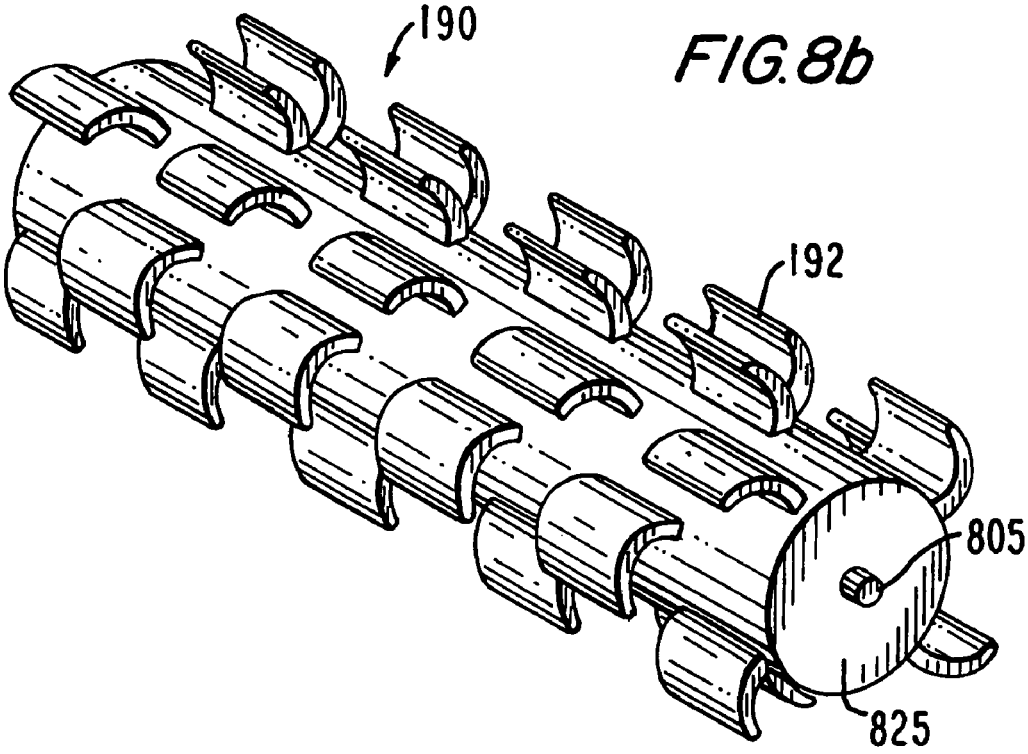
FIG. 8*b* shows an illustrative embodiment of a debris agitator means according to the invention.
Figure 8C:
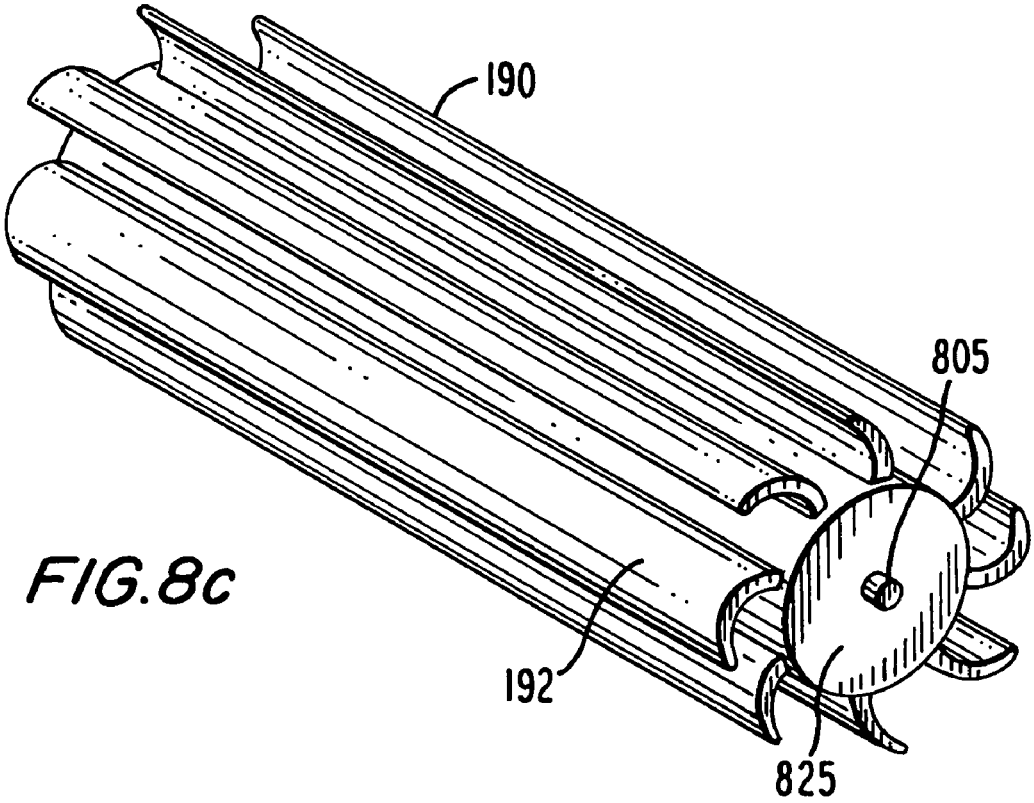
FIG. 8*c* shows an illustrative embodiment of a debris agitator means according to the invention.

Apparatus 100 may further include debris agitator means 190 that assists in the removal of debris from the pool surface. Debris agitator means may include fin means 192 attached to fin housing 825. Fin means 192 may, for example, be flexible, rigid, bristle, and/or bristle-like structures that, when rotated, produce an aqueous current to assist in the removal of debris from the pool surface. Illustrative embodiments of debris agitator means 190 and fin means 192 are shown in FIGS. 8*a*, 8*b*, and 8*c*.

Debris agitator means 190 may be rotatably attached to housing 110 using mounting means 805 (shown in FIGS. 8*a*, 8*b*, and 8*c*) or by any other suitable arrangement. To produce an aqueous current, debris agitator means 190 may be rotated in a counterclockwise direction at a sufficient rate of speed such that the aqueous current produced by fin means 192 assists in forcing debris down the substantially hollow cavity of housing 110 for collection within debris collection means 195. Debris agitator means 190 may be rotated by the force of water against fin means 192 when apparatus 100 is operated in a forward direction, by a mechanical gearing device coupled to wheel means 170, and/or by an electrical power source.

As further shown in FIGS. 1–4, apparatus 100 may also include debris collection means 195 for collecting debris from the pool surface. Debris collection means 195 may include mesh bag 196 (FIG. 1), a series of meshed bags (not shown), single screen collection device 220 (FIG. 2), dual screen collection device 320 (FIG. 3), or any other suitable collection device for collecting debris from a pool surface.

Debris collection device 195 may be attached to housing 110 using debris collection locking means 198. Debris collection locking means may, for example, be a tongue and groove arrangement, a VELCRO® hook-and-loop fastening strap, a buckle device, a clamping device, or any other suitable device and/or arrangement for detachably connecting debris collection means 195 to housing 110.

As shown in FIGS. 1–4, apparatus 100 may also include flow valve 197. Flow valve 197 may be used to prevent debris from reentering housing 110. Flow valve 197 may, for example, be a hinged rubber stopper arrangement that opens when housing 110 is moved in a forward direction and closes when housing 110 moves in a reward direction.

In another embodiment, flow valve 197 may be mechanically geared to the rotation of wheel means 170. For example, when wheel means 170 operates in a forward direction, flow valve 197 will be in open position allowing water and debris to flow into debris collection device 195. Conversely, when wheel means 170 operates in a reverse direction, flow valve 197 will be in a closed position in order to prevent water and debris from flowing back through housing 110.

In still another embodiment, flow valve 197 may be electrically geared to the rotation of wheel means 170. For example, when wheel means 170 operates in a forward direction, an electronic sensor may sense such forward movement and cause flow valve 197 to be in open position allowing water and debris to flow into debris collection device 195. Conversely, when wheel means 170 operates in a reverse direction, an electronic sensor may sense such rearward movement and cause flow valve 197 to be in a closed position in order to prevent water and debris from flowing back through housing 110.

FIG. 2 shows a partial side view of one embodiment of apparatus 100. In this view, the length of handle means 120 may be adjustable. As stated above, when handle means 120 is adjustable, handle means 120 may include handle cylinder 130, handle locking means 135, and handle extension 140. The length of handle means 120 may be adjusted by either collapsing or extending handle extension 140 into or from handle cylinder 130 and by applying handle extension locking means 135. For example, handle cylinder 130 may have a larger diameter than handle extension 140 to allow handle extension 140 to adjustably slide in and out of handle cylinder 130. When handle extension 140 is at a desired length, handle extension locking means 135 may be applied. Handle extension locking means 135 may, for example, be a twist lock device (as shown in FIGS. 1 and 4), a pin (as shown in FIG. 2), a spring-loaded pin (not shown), or any other suitable means for rigidly attaching handle cylinder 130 and handle extension 140 at a fixed desired length.

FIG. 2 also shows one embodiment of debris collection means 195. In this embodiment, debris collection means 195 may include debris collection device 220 that may further include screen 230 and debris removal cap 240. Screen 230 allows debris that is more dense than water to settle at the bottom of debris collection device 240 while allowing water to exit from debris collection device 240 via screen 230. Screen 230 may be a coarse screen, a fine screen, or any combination of coarse and fine screens. Debris removal cap 240 may be used to assist in the removal of debris from debris container device 240. Debris container cap 240 may, for example, be a screw on device, a removable lid secured by a clamping mechanism, or any other suitable device.

FIG. 3 shows a partial side view of an embodiment of handle means 120. In this view, handle means 120 may be at a fixed non-adjustable length. FIG. 3 also shows an embodiment of debris collection means 195. In this embodiment, debris collection means 195 may include debris collection device 220 that may further include screen 230, screen 330, and debris removal cap 240. Screens 230 and 330 allow debris that is more dense than water to settle at the bottom of debris collection device 240 while allowing water to exit from debris collection device 240 via screens 230 and 330. Screens 230 and 330 may include a coarse screen, a fine screen, or any combination of coarse and fine screens. Debris removal cap 240 maybe used to assist in the removal of debris from debris container device 240. Debris container cap 240 may, for example, be a screw on device, a removable lid secured by a clamping mechanism, or any other suitable device that allows access to remove debris from debris container device 220.

FIG. 4 shows a side view of an embodiment of apparatus 100 according to the invention. In this embodiment, apparatus 100 may include secondary debris agitator means 410 to further assist in the removal of debris from the pool surface. Secondary debris agitator means may include propeller 420 or like device, propeller housing 430, and safety screen 440. For example, propeller 420 or like device may be rotatably attached to the inner-top portion of housing 110. Propeller 420 may rotate in a counterclockwise motion in order to create a suction that assists in lifting and removing small debris from the pool surface. The rotation of propeller 420 may be geared to the movement of wheel means 170 or may be operated from an electrical source.

Propeller 420 or like device may be partially surrounded (i.e., top, left side, and right side) by propeller housing 430 and may be attached to housing 110. The bottom side of propeller housing 430 may include an opening such that safety screen 440 may be inserted. Safety screen 440 may, for example, be used to prevent accidental contact with propeller 220.

FIGS. 5 and 6 are top views of two embodiments of apparatus 100. In addition to the items previously described above, apparatus 100 may include gearing/electronic compartment 510 and flow holes 520. Gearing/electronic compartment 510 may be a watertight compartment used to house gearing components that may be used to drive debris agitator means 190 and/or secondary debris agitator means 410. Gearing/electronic compartment 510 may also house electrical components necessary to drive debris agitator means 190, secondary debris agitator means 410, and/or wheel means 170. As shown in FIG. 5, apparatus 100 may also include flow holes 520 to assist in the rotation of debris agitator means 190 and the flow of water through housing 110.

FIG. 7 shows a top rear view of one embodiment of debris collection device 220. In this embodiment, debris that flows through housing 110 and that is more dense than water collects near or on top of debris container cap 240. The filtered water then may exit debris container device 220 via screen 230 and/or screen 330. As stated above, screen 220 and screen 330 may be a coarse screen, a fine screen, or any combination of coarse and fine screens.

As stated above, FIGS. 8*a*, 8*b*, and 8*c* show illustrative embodiments of debris agitator means 190. As also stated above debris agitator means 190 may include fin means 192, fin housing 825, and mounting means 805. Fin means 192 may rigidly or flexibly attached to fin housing 825. Fin means 192 may be flexible, rigid, bristle, and/or bristle-like like structures that, when rotated, produce an aqueous current to assist in the removal of debris from the pool surface. Fin means 192 may also, when rotated, have contact with the pool surface to further assist in the removal of debris.

Debris agitator means 190 may be rotatably attached to housing 110 using mounting means 805 or by any other suitable arrangement. To produce an aqueous current, debris agitator means 190 may be rotated in a counterclockwise direction at a sufficient rate of speed such that the aqueous current produced by fin means 192 assists in forcing debris down the hollow cavity of housing 110 for collection within debris collection means 195. Debris agitator means 190 may be rotated by the force of water against fin means 192 when apparatus 100 is operated in a forward direction, by a mechanical gearing device coupled to wheel means 170, and/or by an electrical power source.

Thus, a device for cleaning a swimming pool without the use of additional hoses or suction devices is provided. Persons skilled in the art will appreciate that the described embodiments are presented for the purpose of illustration rather than limitation and the present invention is limited only by the claims that follow.

What is claimed:

1. An apparatus for cleaning a swimming pool surface, the apparatus comprising:

a housing defined by a top section, a rear section, two side sections, a bottom section, and a substantially hollow cavity that runs along the inner longitudinal axis of the housing;

a handle means mounted to the housing for providing directional control and movement of the housing;

a wheel means movably mounted to the housing for facilitating forward, backward, and angular movement of the housing along the swimming pool surface;

at least one debris agitator means rotatably attached to the housing to facilitate water movement through the housing and the removal of debris from the swimming pool surface;

a scraping means attached to the bottom of the housing for scraping debris from the swimming pool surface; and a debris collection means detachably connected to the housing that filters debris from pool water and that allows filtered pool water to exit from the debris collection means, said debris collection means including a plurality of filtration means comprising at least one first filtration means for facilitating removal of solid debris, and at least one second filtration means for facilitating removal of debris which is smaller than the solid debris removed by the first filtration means.

2. The apparatus in claim 1, wherein the length of the handle means is adjustable.

3. The apparatus in claim 1, wherein the handle means is pivotally attached to the housing.

4. The apparatus of claim 1, wherein the rotation of the debris agitator means is mechanically geared to the rotational movement of the wheel means.

5. The apparatus of claim 1, wherein the rotation of the debris agitator means is electrically operated.

6. The apparatus of claim 1, wherein the rotation of the debris agitator means is provided by the movement of water over the debris agitator means.

7. The apparatus of claim 1, wherein the movement of the wheel means is electrically operated.

8. The apparatus of claim 1, wherein the movement of the wheel means is provided manually via the handle means.

9. An apparatus for cleaning a swimming pool surface, the apparatus comprising:

a housing defined by a top section, a rear section, two side sections, a bottom section, and a substantially hollow cavity that runs along the longitudinal axis of the housing;

a handle means pivotally mounted to the housing for providing directional control of the housing;

an electrically operated wheel means movably mounted to the housing for facilitating forward, backward, and angular movement of the housing along the swimming pool surface;

at least one electrically operated debris agitator means rotatably attached to the housing to facilitate water movement through the housing and the removal of debris from the swimming pool surface, wherein the debris agitator is spring loaded against the pool surface to provide a constant force against the pool surface;

a scraping means attached to the bottom of the housing for scraping the swimming pool surface; and a debris collection means detachably connected to the housing that filters debris from pool water and that allows filtered pool water to exit from the debris collection means, said debris collection means including a plurality of filtration means comprising at least one first filtration means for facilitating removal of solid debris, and at least one second filtration means for facilitating removal of debris which is smaller than the solid debris removed by the first filtration means.

10. The apparatus in claim 9, wherein the length of the handle means is adjustable.

11. An apparatus for cleaning a swimming pool surface, the apparatus comprising:

a housing defined by a top section, a rear section, two side sections, a bottom section, and a substantially hollow cavity that runs along the longitudinal axis of the housing;

an adjustable handle means pivotally mounted to the housing for providing directional control of the housing;

an electrically operated wheel means movably mounted to the housing for facilitating forward, backward, and angular movement of the housing along the swimming pool surface;

at least one electrically operated debris agitator means rotatably attached to the housing to facilitate water movement through the housing and the removal of debris from the swimming pool surface;

a scraping means attached to the bottom of the housing for scraping the swimming pool surface; and a debris collection means detachably connected to the housing that filters debris from pool water and that allows filtered pool water to exit from the debris collection means, wherein the debris collection means further includes a plurality of filtration means comprising:

a first filtration means for facilitating the removal of solid debris; and a second filtration means for facilitating the removal of debris which is smaller than the solid debris removed by the first filtration means.

* * * * *